US009987524B2

(12) United States Patent
Jertson et al.

(10) Patent No.: US 9,987,524 B2
(45) Date of Patent: Jun. 5, 2018

(54) SYSTEM OF GOLF CLUB HEADS WITH REDUCED VARIABILITY IN CHARACTERISTIC TIME AND METHODS OF MANUFACTURING SYSTEMS OF GOLF CLUB HEADS HAVING REDUCED VARIABILITY IN CHARACTERISTIC TIME

(71) Applicant: KARSTEN MANUFACTURING CORPORATION, Phoenix, AZ (US)

(72) Inventors: Martin R. Jertson, Cave Creek, AZ (US); Evan Greer, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days. days.

(21) Appl. No.: 15/206,121

(22) Filed: Jul. 8, 2016

(65) Prior Publication Data

US 2017/0007891 A1 Jan. 12, 2017

Related U.S. Application Data

(60) Provisional application No. 62/191,202, filed on Jul. 10, 2015.

(51) Int. Cl.
*A63B 53/04* (2015.01)
*A63B 53/00* (2015.01)

(52) U.S. Cl.
CPC ..... *A63B 53/0466* (2013.01); *A63B 53/047* (2013.01); *A63B 53/0487* (2013.01); *A63B 2053/005* (2013.01); *A63B 2053/0408* (2013.01); *A63B 2053/0462* (2013.01)

(58) Field of Classification Search
CPC ..... A63B 53/0466
See application file for complete search history.

(56) References Cited

U.S. PATENT DOCUMENTS

| | | | | |
|---|---|---|---|---|
| 3,368,812 | A | 2/1968 | Baldwin, Sr. | |
| 5,141,231 | A | 8/1992 | Cox | |
| 5,405,136 | A | 4/1995 | Hardman | |
| 5,674,132 | A | 10/1997 | Fisher | |
| 6,368,234 | B1 | 4/2002 | Galloway | |
| 6,440,011 | B1 | 8/2002 | Hocknell et al. | |
| 6,482,104 | B1 * | 11/2002 | Gilbert | A63B 53/04 473/287 |
| 6,776,726 | B2 | 8/2004 | Sano | |
| 2001/0001092 | A1 | 5/2001 | Teramoto | |
| 2002/0091014 | A1 | 7/2002 | Aldrich | |
| 2003/0060306 | A1 | 3/2003 | Aldrich | |
| 2003/0092504 | A1 | 5/2003 | Nishio | |
| 2004/0157677 | A1 | 8/2004 | Roach et al. | |
| 2004/0214655 | A1 * | 10/2004 | Reed | A63B 53/047 473/290 |
| 2007/0173346 | A1 | 7/2007 | Chiang et al. | |
| 2009/0247313 | A1 * | 10/2009 | Nakano | A63B 53/0466 473/290 |

(Continued)

OTHER PUBLICATIONS

International Search Report and Written Opinion dated Jul. 10, 2016 from corresponding PCT Application No. PCT/US2016/041636, filed Jul. 8, 2016.

*Primary Examiner* — Michael Dennis

(57) ABSTRACT

A system of golf club heads having reduced variability in characteristic time is disclosed herein. Further, a method of manufacturing a system of golf club heads having reduced variability in characteristic time is disclosed herein.

13 Claims, 7 Drawing Sheets

(56) References Cited

U.S. PATENT DOCUMENTS

| | | | | |
|---|---|---|---|---|
| 2009/0286622 | A1* | 11/2009 | Yokota | A63B 53/0466<br>473/342 |
| 2011/0111885 | A1 | 5/2011 | Golden et al. | |
| 2014/0206469 | A1* | 7/2014 | Girard | A63B 53/02<br>473/287 |
| 2014/0283364 | A1* | 9/2014 | Chiang | A63B 53/04<br>29/527.1 |
| 2016/0346643 | A1* | 12/2016 | Akiyama | A63B 53/0466 |

* cited by examiner

SYSTEM OF GOLF CLUB HEADS WITH REDUCED VARIABILITY IN CHARACTERISTIC TIME AND METHODS OF MANUFACTURING SYSTEMS OF GOLF CLUB HEADS HAVING REDUCED VARIABILITY IN CHARACTERISTIC TIME

CROSS-REFERENCE TO RELATED APPLICATIONS

This claims the benefit of U.S. Provisional Patent Application No. 62/191,202, filed on Jul. 10, 2015, which incorporated fully herein by reference.

FIELD OF INVENTION

The present disclosure relates to a system of golf club heads having reduced variability in characteristic time, and a method of manufacturing a system of golf club heads having reduced variability in characteristic time.

BACKGROUND OF THE INVENTION

Golf club heads are typically designed to optimize performance characteristics. Golf clubs and golf club heads have various measures of performance characteristics, such as, for example, moment of inertia, center of gravity position, swing weight, aerodynamic features, and coefficient of restitution. These performance characteristics may be optimized in many ways, such as through design, materials, or manufacturing methods. Performance characteristics may vary for club heads with similar designs and materials due to manufacturing methods. There is a need in the art for a system of golf club heads having increased predictability in performance characteristics. Further, there is a need in the art for a method of manufacturing a system of golf club heads having increased predictability in performance characteristics.

Figure 1:
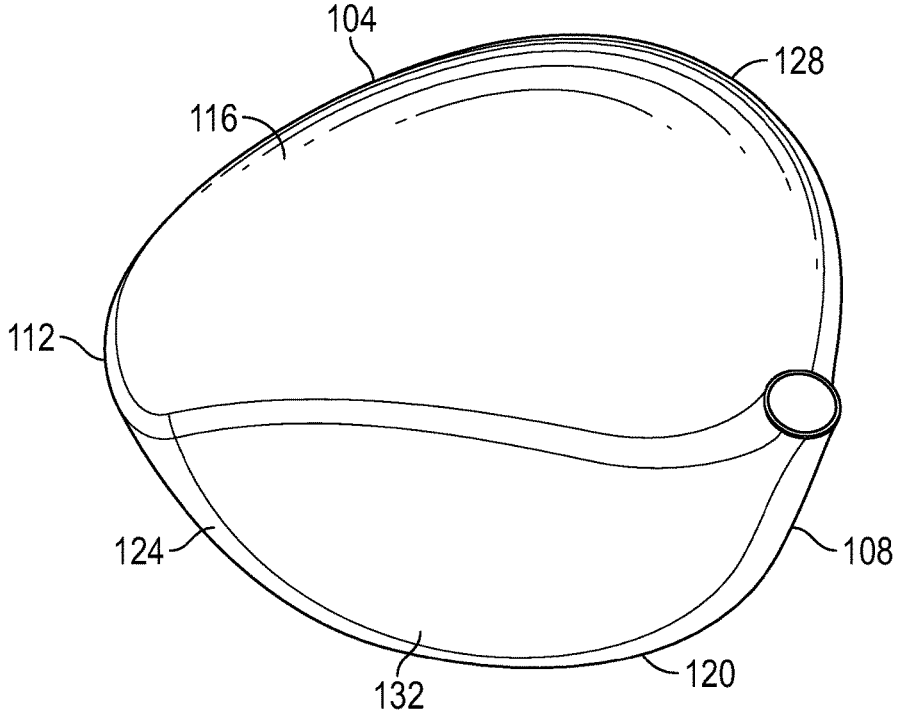
FIG. 1 illustrates a perspective view of an exemplary embodiment of a golf club head.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

A system of golf club heads and golf clubs having reduced variability in characteristic time (CT) is described herein. The system of golf club heads and golf clubs includes golf club heads and golf clubs manufactured within a product category having a particular loft angle. Characteristic time is a measure of face plate elasticity which effects golf ball speed and distance upon impact with a club head. Reduced CT variability is achieved using an optimized manufacturing process on the face plate design. Specifically, reduced CT variability is achieved by optimizing face plate thickness for each face plate within the system of golf club heads. Face plate thickness is optimized based on the elastic modulus of the starting material of the face plate. Reduced CT variability within the system of golf club heads results in increased consistency in ball speed and distance, on average, for the golf clubs within the system of golf clubs. Increased consistency in ball speed and distance, achieved by reducing variation in characteristic time of the golf club heads within the system of golf club heads, results in increased predictability in performance characteristics of the system of golf club heads. For example, a system of golf clubs having a particular loft angle with reduced CT variability can result in increased consistency in ball speed and distance for the golf clubs within the system having that particular loft angle, compared to a system of golf clubs having a higher CT variability. Methods of manufacturing both a system of golf club heads having reduced variability in CT, and a system of golf clubs having reduced variability in CT are also provided.

Described herein, according to one embodiment, is a system of golf club heads comprising a plurality of golf club heads having a plurality of bodies and a plurality of faceplates, the plurality of faceplates having an average elastic modulus and an average thickness profile defining an average maximum thickness and an average minimum thickness, the plurality of golf club heads including an average characteristic time, a range in characteristic time, a first golf club head having a first characteristic time, a first body, and a first face plate, the first face plate including a first elastic modulus, a first thickness profile defining a first maximum thickness and a first minimum thickness, a second golf club head having a second characteristic time, a second body, and a second face plate, the second face plate including a second elastic modulus, a second thickness profile defining a second maximum thickness and a second minimum thickness, and a third golf club head having a third characteristic time, a third body, and a third face plate, the third face plate including a third elastic modulus, a third thickness profile defining a third maximum thickness and a third minimum thickness, wherein the first elastic modulus is within 5% of the average elastic modulus, the second elastic modulus is greater than the average elastic modulus, and the third elastic modulus is less than the average elastic modulus, the first maximum thickness and the first minimum thickness are approximately equal to the average maximum thickness and the average minimum thickness, respectively, the second maximum thickness and the second minimum thickness are less than the average maximum thickness and the average minimum thickness, respectively, and the third maximum thickness and the third minimum thickness are greater than the average maximum thickness and the average minimum thickness, respectively.

Described herein, according to one embodiment, is a method of manufacturing a system of golf club heads, comprising providing a plurality of club head bodies providing a plurality of stocks having an average elastic modulus, the plurality of stocks further including a first stock having a first elastic modulus within 5% of the average elastic modulus, a second stock having a second elastic modulus greater than the average elastic modulus, a third stock having a third elastic modulus less than the average elastic modulus, forming a plurality of face plates from the plurality of stocks, the plurality of face plates having an average thickness profile defining an average maximum thickness and an average minimum thickness, a first face plate formed from the first stock, the first face plate having a first maximum thickness approximately equal to the average maximum thickness, and a first minimum thickness approximately equal to the average minimum thickness, a second face plate formed from the second stock, the second face plate having a second maximum thickness less than the average maximum thickness, and a second minimum thickness less than the average minimum thickness, a third face plate formed from the third stock, the third face plate having a third maximum thickness greater than the average maximum thickness, and a third minimum thickness greater than the average minimum thickness, coupling the plurality of face plates to the plurality of club head bodies to form a plurality of golf club heads.

Described herein, according to one embodiment, is a method of manufacturing a system of golf clubs, comprising providing a plurality of shafts having a first end and a second end, providing a plurality of grips, providing a plurality of club head bodies, providing a plurality of stocks having an average elastic modulus, the plurality of stocks further including a first stock having a first elastic modulus the same as the average elastic modulus, a second stock having a second elastic modulus greater than the average elastic modulus, a third stock having a third elastic modulus less than the average elastic modulus, forming a plurality of face plates from the plurality of stocks, the plurality of face plates having, an average thickness profile defining an average maximum thickness and an average minimum thickness, a first face plate formed from the first stock, the first face plate having a first maximum thickness approximately equal to the average maximum thickness, and a first minimum thickness approximately equal to the average minimum thickness, a second face plate formed from the second stock, the second face plate having a second maximum thickness less than the average maximum thickness, and a second minimum thickness less than the average minimum thickness, a third face plate formed from the third stock, the third face plate having a third maximum thickness greater than the average maximum thickness, and a third minimum thickness greater than the average minimum thickness, coupling the plurality of face plates to the plurality of club head bodies to form a system of golf club heads, coupling the system of golf club heads to the first end of the plurality of shafts, and coupling the plurality of grips to the second end of the plurality of shafts to form a system of golf clubs.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

As defined herein, a "system" of golf clubs refers to all the golf clubs manufactured within a product category of golf clubs having a particular loft, and a "system" of golf club heads refers to all the golf club heads manufactured within a product category of golf club heads having a particular loft.

As defined herein, "elastic modulus" is a measure of the elasticity of a material and can be measured in gigapascals (GPa). Specifically, the elastic modulus indicates a material's resistance to elastic deformation. Generally, a material having a higher elastic modulus is more resistant to elastic deformation than a material having a lower elastic modulus.

As defined herein, "approximately equal to" described in relation to thickness, thickness profile, maximum thickness, minimum thickness, average thickness, average thickness profile, average maximum thickness, and average minimum thickness, refers to a value within standard manufacturing tolerances.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

A. Golf Club Head

Figure 2:
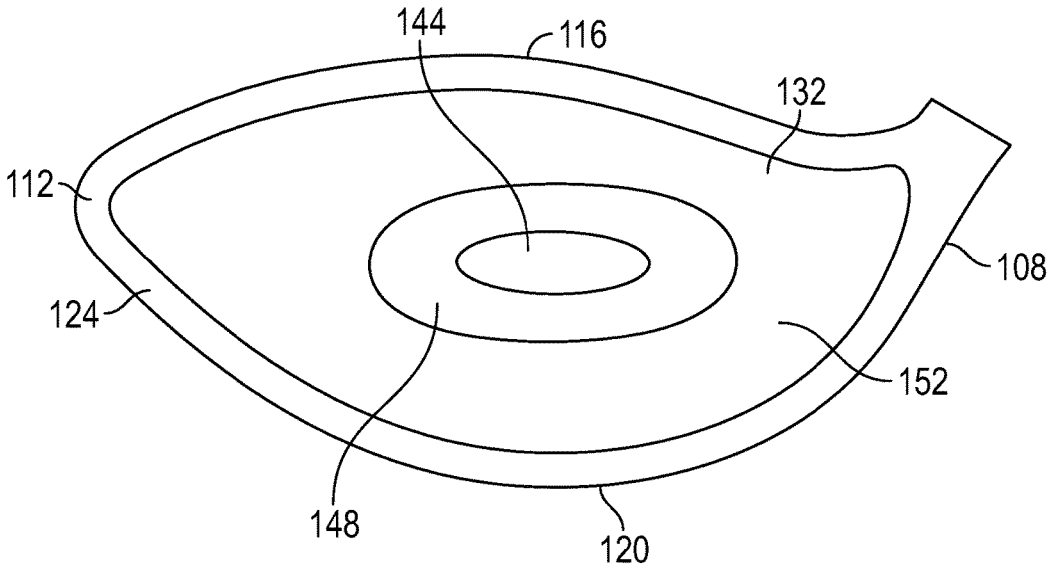
FIG. 2 illustrates a front view of the exemplary golf club head in FIG. 1.
Figure 3:
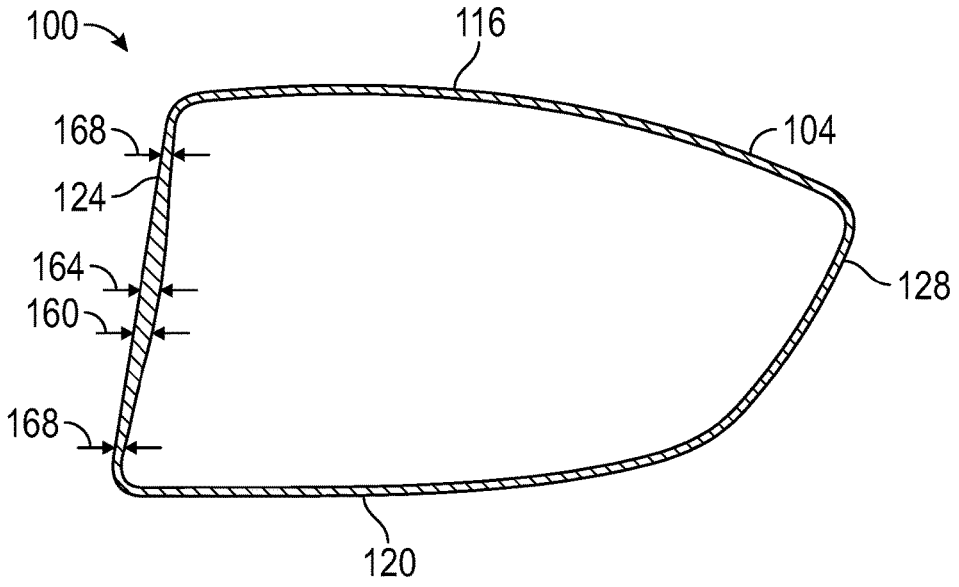
FIG. 3 illustrates a side view of the exemplary golf club head in FIG. 1.

FIGS. 1-3 illustrate a golf club head 100 including a body 104 having a heel portion 108, a toe portion 112 opposite the heel portion 108, a top portion 116, a bottom portion 120 opposite the top portion 116, a front end 124, and a back end 128 opposite the front end. The club head further includes a face plate 132 positioned adjacent to the front end 124 of the body 104.

The club head 100 illustrated in FIGS. 1-3 may be any type of club head. For example, the club head may be a driver-type club head, a fairway wood-type club head, a hybrid-type club head, an iron-type club head, a wedge-type club head, or a putter-type club head.

Referring to FIGS. 1-3, the face plate 132 of the club head 100 includes a center region 144, a transition region 148, and a perimeter region 152. The face plate 132 further includes an elastic modulus and a thickness or thickness profile 160. For example, the thickness profile 160 of the face plate 132 may vary across the center region 144, the transition region 148, and/or the perimeter region 152. In the illustrated embodiment, the thickness profile 160 of the face plate 132 is thickest in the center region 144, defining a maximum thickness 164. Further, the thickness profile 160 is thinnest in the perimeter region 152, defining a minimum thickness 168. The thickness profile 160 decreases gradually in the transition region 148 moving toward the perimeter region 152.

In other embodiments, the thickness profile 160 may remain constant across the center region 144, the transition region 148, and/or the perimeter region 152, or the thickness profile 160 may vary according to any profile in the transition region 148. For example, the thickness profile 160 may decrease in a linear capacity, an exponential capacity, a polynomial capacity, or in any other capacity in the transition region 148 moving toward the perimeter region 152.

In the illustrated embodiment, the face plate 132 may comprise any material such as titanium, steel, other metals, metal alloys, composites, or any other suitable material. For example, the face plate 132 may comprise a titanium alloy such as Ti-9s which contains approximately 6-8.5 wt % aluminum, approximately 1-2 wt % vanadium, and approximately 0.2 wt % silicon, with the remaining alloy composition being titanium and other trace elements. For further example, the face plate 132 may comprise a titanium alloy such as Ti-6-4 which contains approximately 5.5 wt %-6.75 wt % aluminum, approximately 3.5 wt %-4.5 wt % vanadium, with the remaining alloy composition being titanium and other trace elements. For further, example, the face plate 132 may comprise a titanium alloy such as Ti-8-1-1 which contains approximately 8 wt % aluminum, approximately 1.0 wt % molybdenum, and approximately 1 wt % vanadium, with the remaining alloy composition being titanium and other trace elements. For further example, the face plate 132 may comprise a steel alloy such as 17-4 stainless steel which contains approximately 15 wt %-17.5 wt % chromium, approximately 3-5 wt % copper, approximately 3-5 wt % nickel, with the remaining alloy composition being iron and other trace elements. For further example, the face plate 132 may comprise a steel alloy such as C300 which contains approximately 7.5-12 wt % cobalt, approximately 4.8 wt % molybdenum, approximately 0.40-1.40 wt % titanium, approximately 0.10 wt % aluminum, with the remaining alloy composition being iron and other trace elements.

The body 104 may comprise the same material as the face plate 132, or the body 104 may comprise a different material 132 than the face plate 132. The body 104 may comprise any material such as titanium, steel, other metals, metal alloys, composites, or any other suitable material. For example, the body 104 may comprise a titanium alloy such as Ti-9s which contains approximately 6-8.5 wt % aluminum, approximately 1-2 wt % vanadium, and approximately 0.2 wt % silicon, with the remaining alloy composition being titanium and other trace elements. For further example, the body 104 may comprise a titanium alloy such as Ti-6-4 which contains approximately 5.5 wt %-6.75 wt % aluminum, approximately 3.5 wt %-4.5 wt % vanadium, with the remaining alloy composition being titanium and other trace elements. For further, example, the body 104 may comprise a titanium alloy such as Ti-8-1-1 which contains approximately 8 wt % aluminum, approximately 1.0 wt % molybdenum, and approximately 1 wt % vanadium, with the remaining alloy composition being titanium and other trace elements. For further example, the body 104 may comprise a steel alloy such as 17-4 stainless steel which contains approximately 15 wt %-17.5 wt % chromium, approximately 3-5 wt % copper, approximately 3-5 wt % nickel, with the remaining alloy composition being iron and other trace elements. For further example, the body 104 may comprise a steel alloy such as C300 which contains approximately 7.5-12 wt % cobalt, approximately 4.8 wt % molybdenum, approximately 0.40-1.40 wt % titanium, approximately 0.10 wt % aluminum, with the remaining alloy composition being iron and other trace elements.

1. Characteristic Time

The club head 100 having the body 104 and the face plate 132 further includes a characteristic time. Characteristic time is a performance characteristic used to measure the elasticity or flexibility of a face plate of a golf club head. Specifically, a golf club head having a higher characteristic time has increased face plate elasticity compared to a golf club head having a lower characteristic time. Increased face plate elasticity of a golf club head results in increased energy transfer to a golf ball. Therefore, the higher the characteristic time of a golf club head, the greater the speed and distance of the golf ball.

Characteristic time is measured using a standardized pendulum test. The standardized pendulum test measures characteristic time of a golf club head as the duration of time (in microseconds, μs) a metal ball is in contact with the face plate of the golf club head on impact. Characteristic time is regulated by the United States Golf Association (USGA). Specifically, to conform to USGA regulations, the characteristic time of a golf club head must be less than 257 μs.

The characteristic time of the golf club head 100 is affected by at least the elastic modulus and the thickness 160 of the face plate 132. The effect of the elastic modulus, and the thickness 160 of the face plate 132 on the characteristic time of the club head 100 are described in detail below.

2. Effect of Elastic Modulus on Characteristic Time of the Golf Club Head

Figure 4:
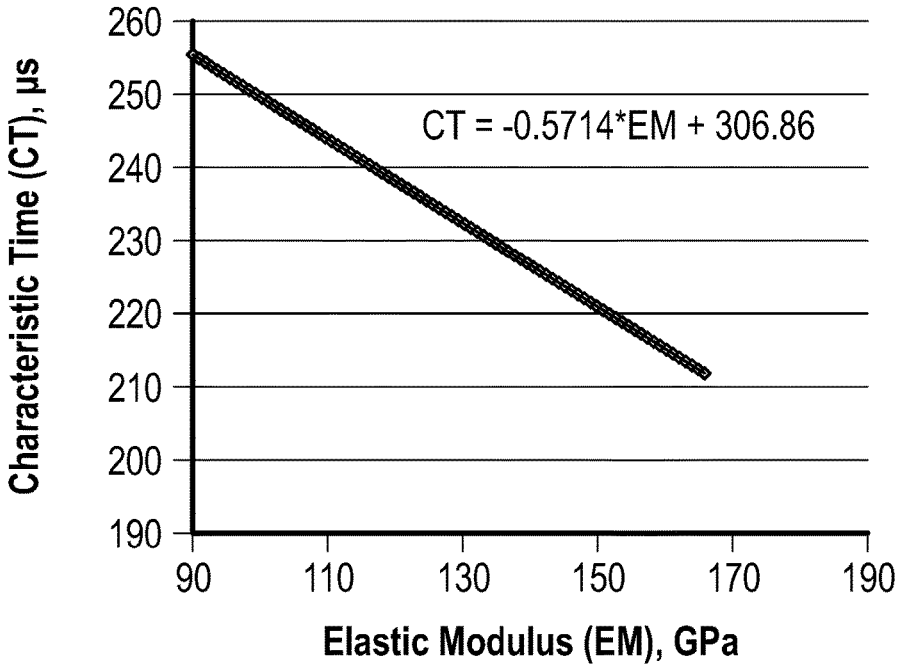
FIG. 4 illustrates an exemplary relation between characteristic time and elastic modulus of the exemplary golf club head in FIG. 1.

The characteristic time of the golf club head 100 increases as the elastic modulus of the face plate 132 decreases. Conversely, the characteristic time of the golf club head 100 decreases as the elastic modulus of the face plate 132 increases. FIG. 4 illustrates the variation in characteristic time of an exemplary driver-type club head with the elastic modulus of the face plate 132, wherein the face plate 132 of the exemplary driver type club head is made of Ti-9s. In the illustrated example, the characteristic time (CT) varies with the elastic modulus (EM) of the face plate 132 according to Relation 1 below.

$$CT=-0.5714*EM+306.86 \qquad \text{Relation 1}$$

Referring to FIG. 4, the relation between the characteristic time and the elastic modulus of the face plate 132 may vary for golf club heads having face plates made of different materials, for golf club heads having different body designs, and/or for different types of golf club heads (e.g., fairway wood-type club heads, hybrid-type club heads, iron-type club heads, wedge-type club heads, or putter-type club heads). For example, in other embodiments, the curve in FIG. 5 may vary in downward slope, or may shift to the left, to the right, up, or down. While Relation 1 may vary for golf club heads having face plates made of different materials, for golf club heads having different body designs, and/or for different types of golf club heads, the trend discussed above will remain the same.

3. Effect of Face Plate Thickness on Characteristic Time of the Golf Club Head

Figure 5:
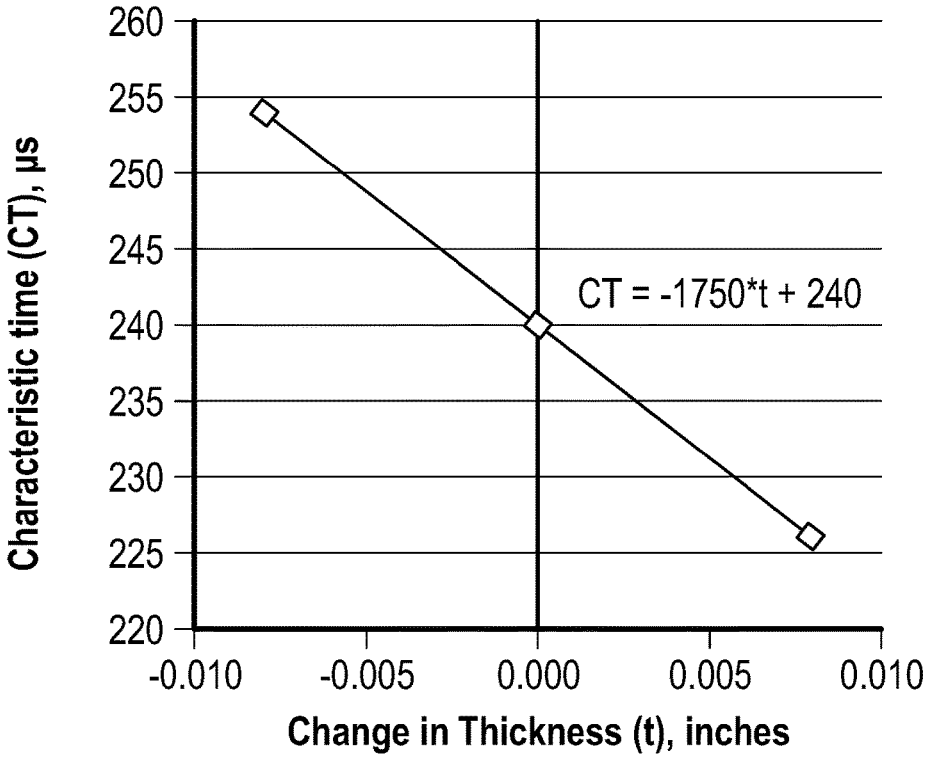
FIG. 5 illustrates an exemplary relation between characteristic time and face plate thickness of the exemplary golf club head in FIG. 1.

The characteristic time of the golf club head 100 increases as the thickness 160 of the face plate 132 decreases. Conversely, the characteristic time of the golf club head 100 decreases as the thickness 160 of the face plate 132 increases. FIG. 5 illustrates the variation in characteristic time of an exemplary driver-type club head with the thickness 160 of the face plate 132, wherein the face plate 132 of the exemplary driver type club head is made of Ti-9s. The thickness 160 of the face plate 132 in FIG. 5 is normalized to illustrate variation or change in the thickness 160. In the illustrated example, the characteristic time (CT) varies with the thickness (t) of the face plate 132 according to Relation 2 below.

$$CT=-1750*t+240 \quad \text{Relation 2}$$

Referring to FIG. 5, the relation between the characteristic time and the thickness 160 of the face plate 132 may vary for golf club heads having face plates made of different materials, for golf club heads having different body designs, and/or for different types of golf club heads (e.g., fairway wood-type club heads, hybrid-type club heads, iron-type club heads, wedge-type club heads, or putter-type club heads). For example, in other embodiments, the curve in FIG. 5 may vary in downward slope, or may shift to the left, to the right, up, or down. While Relation 2 may vary for golf club heads having face plates made of different materials, for golf club heads having different body designs, and/or for different types of golf club heads, the trends discussed above will remain the same.

The golf club head 100 described herein, having the characteristic time determined at least by the elastic modulus and the thickness 160 of the face plate 132, may be part of a system of golf club heads, as described below.

B. System of Golf Club Heads Having Reduced Variability in Characteristic Time

Figure 6:
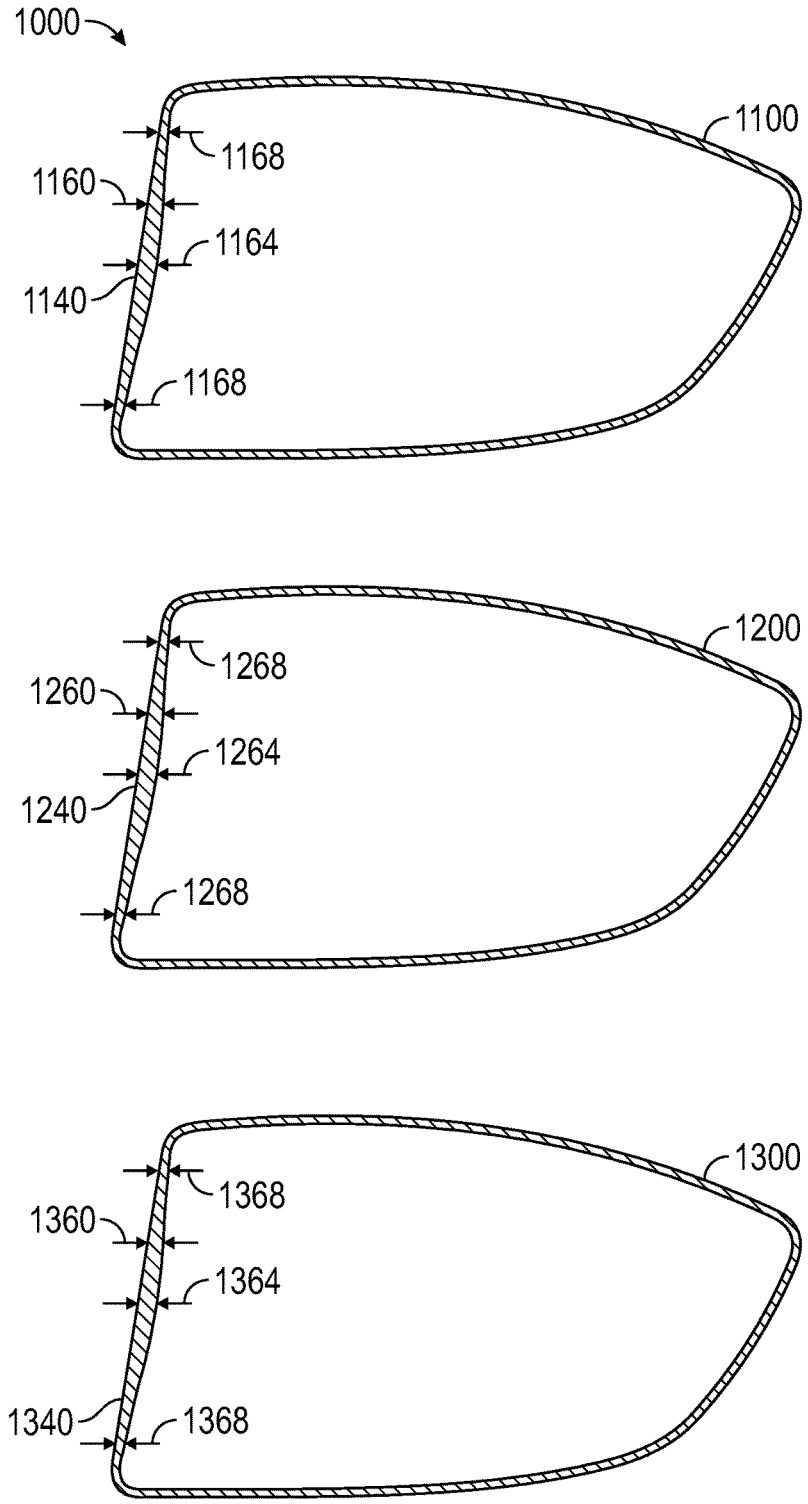
FIG. 6 illustrates a side view of an exemplary system of golf club heads.

Referring to FIG. 6, the club head 100 described herein may be part of a system of golf club heads 1000. The system of golf club heads 1000 includes a plurality of golf club heads having similar club head type. For example, in one embodiment, the plurality of golf club heads can include driver-type golf club heads. In other embodiments, the plurality of golf club heads can include fairway wood-type golf club heads, hybrid-type golf club heads, iron-type golf club heads, wedge-type golf club heads, or putter-type golf club heads.

The system of golf club heads 1000 includes a plurality of golf club heads having a plurality of bodies. Each body within the plurality of bodies may be similar to the body 104 described above. The plurality of golf club heads further includes a plurality of face plates. Each face plate within the plurality of face plates may be similar to the face plate 132 described above. For example, each face plate within the plurality of face plates may have an elastic modulus and a thickness or thickness profile 160, similar to face plate 132.

In the illustrated embodiment, the face plates within the plurality of face plates may vary while each body within the plurality of bodies is substantially the same. For example, the elastic modulus of each face plate within the plurality of face plates may vary, as described in detail below. For further example, the thickness or thickness profile 160 of each face plate within the plurality of face plates may vary according to variations in the elastic modulus, as described in detail below.

The system of golf club heads 1000 has an average characteristic time. The average characteristic time is the average of the characteristic time of each golf club head within the system of golf club heads. The characteristic time of each golf club head within the system of golf club heads 1000 may vary from the average characteristic time due to variations in the elastic modulus and the thickness 160 of each face plate within the plurality of face plates. For example, the characteristic time of a particular golf club head within the system of golf club heads 1000 may be greater than the average characteristic time of the system of golf club heads 1000. Conversely, the characteristic time of a particular golf club head within the system of golf club heads 1000 may be less than the average characteristic time of the system of golf club heads 1000. The characteristic time of each golf club head within the system of club heads 1000 must remain within USGA conformance limits. Accordingly, for each golf club head to remain within USGA conformance limits, the average characteristic time of the system of golf club heads must be less than 257 μs to account for variation in characteristic time of the system of golf club heads.

In the illustrated embodiment of FIG. 6, the system of golf club heads 1000 includes a first golf club head 1100 having a first face plate 1140 coupled to one of the plurality of bodies, a second golf club 1200 head having a second face plate 1240 coupled to one of the plurality of bodies, and a third golf club head 1300 having a third face plate 1340 coupled to one of the plurality of bodies. In other embodiments, the system of golf club heads 1000 may include any number of golf club heads.

In the illustrated embodiment of FIG. 6, the first golf club head 1100 has a first characteristic time, the second golf club head 1200 has a second characteristic time, and the third golf club head 1300 has a third characteristic time. Further, in the illustrated embodiment, the average characteristic time of the system of golf club heads 1000 is the average of the first characteristic time, the second characteristic time, and the third characteristic time.

The first, the second, and the third characteristic times vary thereby defining a range in characteristic time for the system of golf club heads 1000. Minimizing or reducing the range in characteristic time of a system of golf club heads can improve consistency in ball speed and distance. Further, minimizing or reducing the range in characteristic time of a system of golf club heads may allow an increase in the average characteristic time of the system of golf club heads, while allowing each golf club head within the system of golf club heads to remain within the USGA conformance limit. Increasing the average characteristic time of the system of golf club heads results in increased ball speed and distance, on average, of the system of golf club heads.

Minimizing or reducing the range in characteristic time of the system of golf club heads 1000 can be achieved by varying the thickness 160 of each face plate within the plurality of face plates according to the elastic modulus of each face plate within the plurality of face plates. Inherent variations exist in the elastic modulus of each face plate within the plurality of face plates, and corresponding alterations in the thickness of each face plate within the plurality of face plates can minimize or reduce the range in characteristic time of the system of golf club heads 1000, are discussed in detail below.

1. Variation in Elastic Modulus of the Plurality of Face Plates

The elastic modulus of each face plate within the plurality of face plates may vary, leading to variation in characteristic time of the golf clubs within the system of golf club heads 1000. In the illustrated embodiment, the plurality of face plates, including the first face plate 1140, the second face plate 1240, and the third face plate 1340, are made from a plurality of stocks comprising the same material. For example, the first, the second, and the third face plates 1140, 1240, 1340 are made from a first stock, a second stock, and a third stock, respectively. The first stock has a first elastic modulus, the second stock has a second elastic modulus, and the third stock has a third elastic modulus. Therefore, the first face plate 1140 has the first elastic modulus, the second face plate 1240 has the second elastic modulus, and the third face plate 1340 has the third elastic modulus.

The first stock, the second stock, and the third stock comprise the same material, such as, for example, Ti-9s. Therefore, the first face plate 1140, the second face plate 1240, and the third face plate 1340 comprise the same material. However, the first elastic modulus of the first stock, the second elastic modulus of the second stock, and the third elastic modulus of the third stock may vary due to impurities within the material or inconsistencies in material processing. Therefore, the first elastic modulus of the first face plate 1140, the second elastic modulus of the second face plate 1240, and the third elastic modulus of the third face plate 1340 may vary. Similarly, the elastic modulus of each face plate within the plurality of face plates may vary.

The plurality of face plates has an average elastic modulus. The average elastic modulus is the average of the elastic modulus of all of the face plates within the plurality of face plates. The elastic modulus of each face plate within the plurality of face plates may vary from the average elastic modulus. For example, the elastic modulus of a particular face plate within the plurality of face plates may be greater than the average elastic modulus of the system of the plurality of face plates. Conversely, the elastic modulus of a particular face plate within the plurality of face plates may be less than the average elastic modulus of the system of the plurality of face plates.

For example, in the illustrated embodiment of FIG. 6, the average elastic modulus is the average of the first elastic modulus, the second elastic modulus, and the third elastic modulus. The first elastic modulus of the first face plate 1140 can be within 5% of the average elastic modulus, the second elastic modulus of the second face plate 1240 can be greater than the average elastic modulus, and the third elastic modulus of the third face plate 1340 can be less than the average elastic modulus.

2. Variation in Thickness of the Plurality of Face Plates

The thickness of each face plate within the plurality of face plates may be adjusted or optimized according to the elastic modulus of each stock within the plurality of stocks to reduce variation in characteristic time of the system of golf club heads. Optimizing the thickness of each face plate according to the elastic modulus of each stock can minimize or reduce the variation in characteristic time of the system of golf club heads 1000 due to inherent variations in the elastic modulus of the plurality of stocks used to make the plurality of face plates. Modifying the thickness of each face plate within the plurality of face plates is one method to minimize or reduce the range in characteristic time of the system of golf club heads 1000.

The range in characteristic time of the system of golf club heads 1000 can be reduced or minimized by varying the thickness 160 of each face plate within the plurality of face plates. The plurality of face plates has an average thickness or an average thickness profile. The thickness or thickness profile 160 of each face plate within the plurality of face plates varies from the average thickness or average thickness profile of the plurality of face plates, respectively. For example, the thickness 160 of a particular face plate within the plurality of face plates may be greater than the average thickness of the plurality of face plates. Conversely, the thickness 160 of a particular face plate within the plurality of face plates may be less than the average thickness of the plurality of face plates.

In the illustrated embodiment, the average thickness profile of the system of golf club heads 1000 includes an average maximum thickness and an average minimum thickness. The first face plate 1140 has a first maximum thickness 1164 and a first minimum thickness 1168; the second face plate 1240 has a second maximum thickness 1264 and a second minimum thickness 1268; and the third face plate 1340 has a third maximum thickness 1364 and a third minimum thickness 1368. The average maximum thickness is the average of the maximum thickness of each face plate within the plurality of face plates. Similarly, the average minimum thickness is the average of the minimum thickness of each face plate within the plurality of face plates. For example, in the illustrated embodiment, the average maximum thickness is the average of the first maximum thickness 1164, the second maximum thickness 1264, and the third maximum thickness 1364. Similarly, in the illustrated embodiment, the average minimum thickness is the average of the first minimum thickness 1168, the second minimum thickness 1268, and the third minimum thickness 1368.

The thickness profile (e.g., the maximum thickness and/or the minimum thickness) of a particular face plate within the plurality of face plates may be greater than the average thickness profile (e.g., the average maximum thickness and/or the average minimum thickness) of the plurality of face plates. Conversely, the thickness profile (e.g., the maximum thickness and/or the minimum thickness) of a particular face plate within the plurality of face plates may be less than the average thickness profile (e.g., the average maximum thickness and/or the average minimum thickness) of the system of the plurality of face plates.

In the illustrated embodiment, the maximum thickness and the minimum thickness of each face plate within the plurality of face plates varies from the average maximum thickness and the average minimum thickness, respectively. Specifically, the first maximum thickness 1164 and the first minimum thickness 1168 are approximately equal to the average maximum thickness and the average minimum thickness, respectively. Further, the second maximum thickness 1264 and the second minimum thickness 1268 are less than the average maximum thickness and the average minimum thickness, respectively. Further still, the third maximum thickness 1364 and the third minimum thickness 1368 are greater than the average maximum thickness and the average minimum thickness, respectively.

In the illustrated embodiment, the maximum thickness and the minimum thickness of the face plates within the plurality of face plates vary similarly relative to the average maximum thickness and the average minimum thickness, respectively. In other embodiments, only one of the maximum thickness or the minimum thickness of each face plate within the plurality of face plates may vary relative to the average maximum thickness or the average minimum thickness, respectively. For example, in some embodiments, the maximum thickness of the face plates within the plurality of face plates may vary while the minimum thickness remains substantially the same as the average minimum thickness. For further example, in some embodiments, the minimum thickness of the face plates within the plurality of face plates may vary while the maximum thickness remains substantially the same as the average maximum thickness.

The variation in thickness of the face plates within the plurality of face plates, as described herein, minimizes or reduces the range in characteristic time of the system of golf club heads 1000. For example, in the illustrated embodiment, the first elastic modulus is within 5% of the average elastic modulus. Therefore, first maximum thickness 1164 and the first minimum thickness 1168 of the first face plate are approximately equal to the average maximum thickness and the average minimum thickness, respectively, to achieve the first golf club head having the first characteristic time, approximately equal to the average characteristic time.

Further, in the illustrated embodiment, the second elastic modulus is greater than the average elastic modulus. Therefore, the second maximum thickness 1264 and the second minimum thickness 1268 are less than the average maximum thickness and the average minimum thickness, respectively, to achieve the second golf club head having the second characteristic time. The second characteristic time of the second club head is closer to the average characteristic time of the system of golf club heads than the characteristic time of a golf club head having a face plate with the second elastic modulus and the average thickness profile (e.g., the average maximum thickness and the average minimum thickness).

Further, in the illustrated embodiment, the third elastic modulus is less than the average elastic modulus. Therefore, the third maximum thickness 1364 and the third minimum thickness 1368 are greater than the average maximum thickness and the average minimum thickness, respectively, to achieve the third golf club head having the third characteristic time. The third characteristic time of the third club head is closer to the average characteristic time of the system of golf club heads than the characteristic time of a golf club head having a face plate with the third elastic modulus and the average thickness profile (e.g., the average maximum thickness and the average minimum thickness).

C. Method of Manufacturing the System of Golf Club Heads Having Reduced Variability in Characteristic Time A method of manufacturing the system of golf club heads 1000 is described below. The method described below can be used to manufacture the system of golf club heads having thickness profiles that vary according to elastic modulus to reduce or minimize the range in characteristic time of the system of golf club heads 1000.

Figure 7:
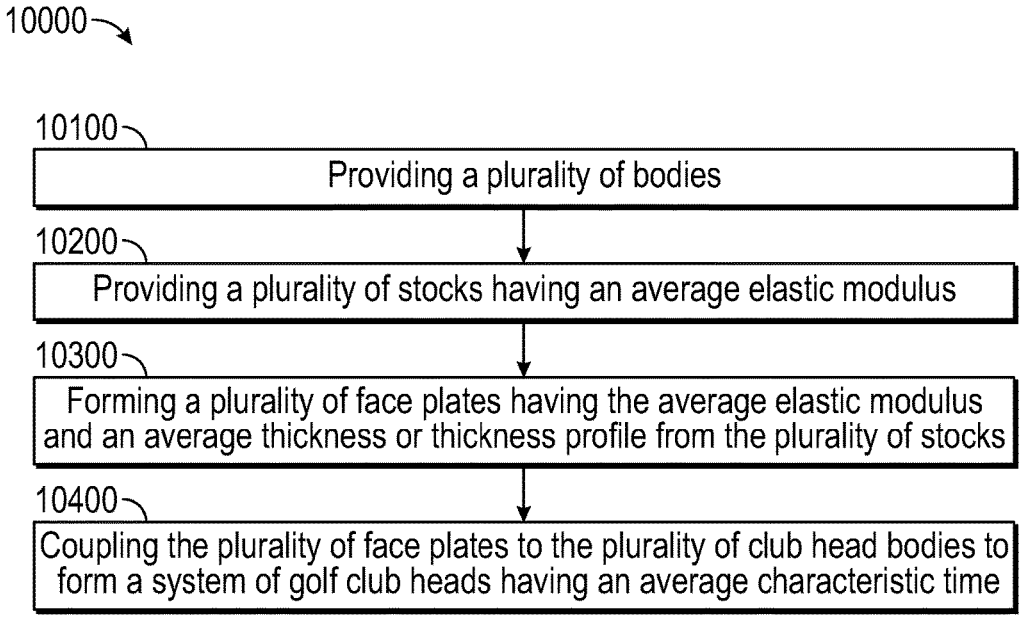
FIG. 7 illustrates a flow chart of an exemplary method of manufacturing the system of golf club heads in FIG. 6.

FIG. 7 illustrates a method 10000 of manufacturing the system of golf club heads 1000 to minimize or reduce the range in characteristic time. The method 10000 includes block 10100, block 10200, and block 10300, and block 10400. Block 10100 of method 10000 includes providing a plurality of bodies.

Block 10200 of method 10000 includes providing the plurality of stocks having the average elastic modulus. In the illustrated embodiment, the plurality of stocks includes the first stock having the first elastic modulus within 5% of the average elastic modulus. The plurality of stocks further includes the second stock having the second elastic modulus less than the average elastic modulus. The plurality of stocks further includes the third stock having the third elastic modulus greater than the average elastic modulus.

Block 10300 of method 10000 includes forming the plurality of face plates having the average elastic modulus and the average thickness profile 160 (e.g., the average maximum thickness and the average minimum thickness) from the plurality of stocks. For example, in the illustrated embodiment, block 10300 includes forming the first face plate 1140 having the first elastic modulus from the first stock, forming the second face plate 1240 having the second elastic modulus from the second stock, and forming the third face plate 1340 having the third elastic modulus from the third stock.

Referring to block 10300 of method 10000, the first, the second, and the third face plates 1140, 1240, 1340 are formed with varying thickness profiles 160 according to the first, the second, and the third elastic modulus. For example, in the illustrated embodiment, the first face plate 1140 (having the first elastic modulus within 5% of the average elastic modulus) is formed with the first thickness profile 1160. The first thickness profile 1160 is approximately equal to the average thickness profile. Specifically, the first thickness profile 1160 is formed such that the first maximum thickness 1164 is approximately equal to the average maximum thickness, and the first minimum thickness 1168 is approximately equal to the average minimum thickness.

Further referring to block 10300 of method 10000, in the illustrated embodiment, the second face plate 1240 (having the second elastic modulus greater than the average elastic modulus) is formed with the second thickness profile 1260. The second thickness profile 1260 is less than the average thickness profile. Specifically, the second thickness profile 1260 is formed such that the second maximum thickness 1264 is less than the average maximum thickness, and the second minimum thickness 1268 is less than the average minimum thickness.

In other embodiments, only one of the second maximum thickness 1264 or the second minimum thickness 1268 may be less than the average maximum thickness or the average minimum thickness, respectively. For example, the second maximum thickness 1264 may be less than the average maximum thickness while the second minimum thickness 1268 is approximately equal to the average minimum thickness. For further example, the second minimum thickness 1268 may be less than the average minimum thickness while the second maximum thickness 1264 is approximately equal to the average maximum thickness.

Further referring to block 10300 of method 10000, in the illustrated embodiment, the third face plate 1340 (having the third elastic modulus less than the average elastic modulus) is formed with the third thickness profile 1360. The third thickness profile is greater than the average thickness profile. Specifically, the third thickness profile 1360 is formed such that the third maximum thickness 1364 is greater than the average maximum thickness, and the third minimum thickness 1368 is greater than the average minimum thickness.

In other embodiments, only one of the third maximum thickness 1364 or the third minimum thickness 1368 may be greater than the average maximum thickness or the average minimum thickness, respectively. For example, the third maximum thickness 1364 may be greater than the average maximum thickness while the third minimum thickness 1368 is approximately equal to the average minimum thickness. For further example, the third minimum thickness 1368 may be greater than the average minimum thickness while the third maximum thickness 1364 is approximately equal to the average maximum thickness.

In many embodiments, each of the plurality of face plates can be formed by machining, casting, layer by layer printing, or any other suitable method. Block 10300 of method 10000 is not limited in this regard.

Block 10400 of method 10000 includes coupling the plurality of face plates to the plurality of club head bodies to form the system of golf club heads 1000 having the average characteristic time. For example, the first face plate 1140 may be coupled to one of the plurality of bodies to form the first golf club head 1100 having the first characteristic time. Similarly, the second face plate 1240 may be coupled to one of the plurality of bodies to form the second golf club head 1200 having the second characteristic time. Similarly, the third face plate 1340 may be coupled to one of the plurality of bodies to form the third golf club head 1300 having the third characteristic time.

In many embodiments, the plurality of face plates can be coupled to the plurality of club head bodies by welding, sintering, diffusion bonding, or any other suitable method. Block 10400 of method 10000 is not limited in this regard.

The blocks of the method 10000 of manufacturing the system of club heads 1000 to minimize or reduce the range in characteristic time can be combined into a single block or performed simultaneously. Further, the method 10000 of manufacturing the system of club heads 1000 to minimize or reduce the range in characteristic time can include additional or different blocks. Other variations can be implemented for method 10000 without departing from the scope of the present disclosure.

In the illustrated embodiment, the method 10000 of manufacturing is described with reference to the system of golf club heads 1000 having three golf club heads, including the first golf club head 1100, the second golf club head 1200, and the third golf club head 1300. In other embodiments, the method of manufacturing the system of golf club heads may be used to manufacture any system of golf club heads having any number of golf club heads to minimize or reduce the range in characteristic time of the system of golf club heads.

Block 10300 of method 10000 may be implemented in a variety of ways. For example, the thickness or thickness profiles 160 of the plurality of face plates may vary discretely or continuously based on the elastic modulus of the stock. Examples 1 and 2, detailed below, describe exemplary processes of forming the plurality of face plates with thicknesses that vary discretely and continuously, according to the elastic modulus of the stock.

Figure 8:
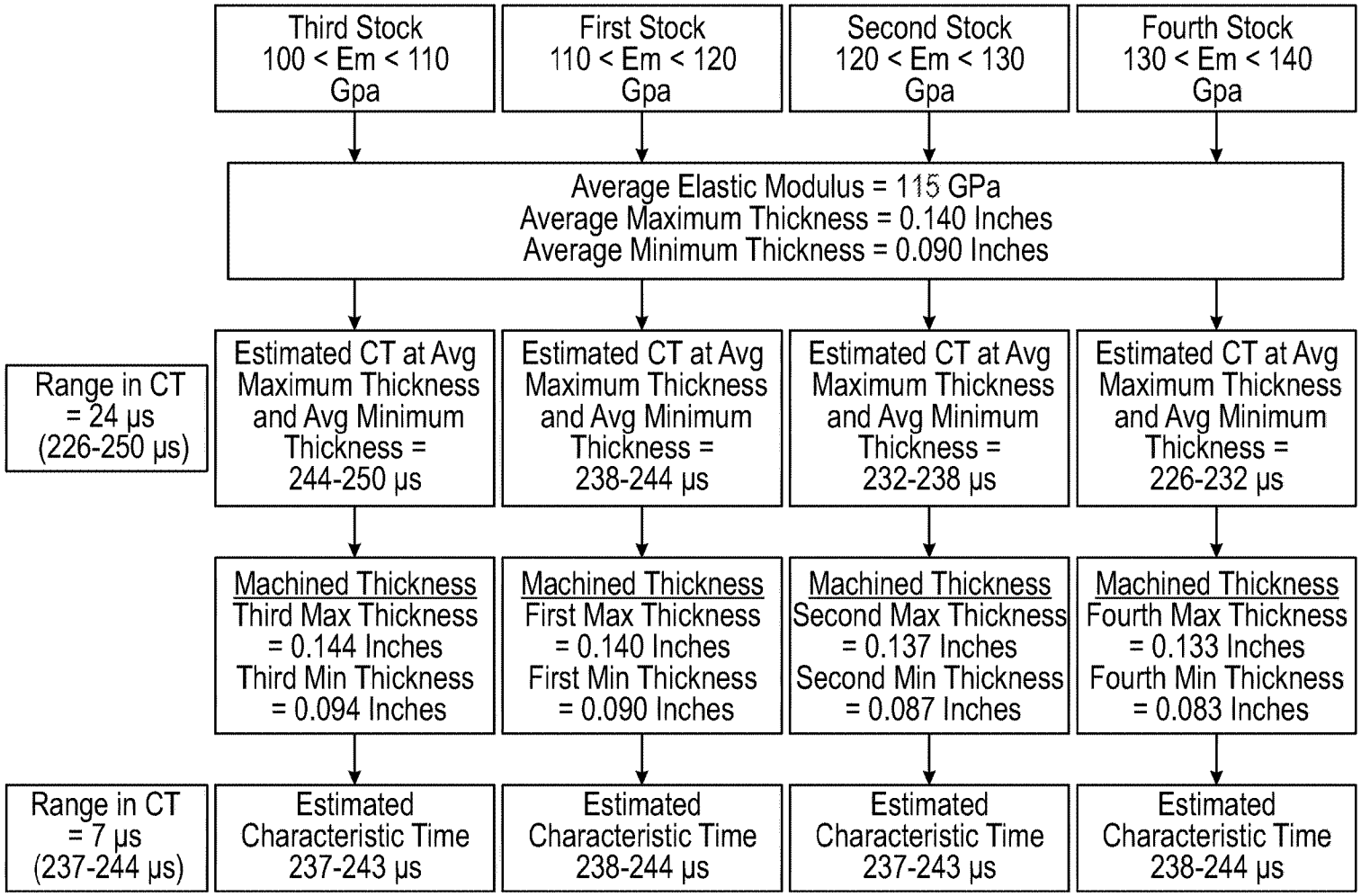
FIG. 8 illustrates a flow chart of an exemplary process of forming the face plates of the exemplary system of golf club heads in FIG. 6.

Example 1: Thickness Varying Discretely with Elastic Modulus of Face Plate, Resulting in the System of Golf Club Heads with Reduced Variability in Characteristic Time FIG. 8 illustrates an exemplary process of forming the plurality of face plates with thickness profiles 160 that vary discretely according to the elastic modulus. The exemplary process described herein relates to an exemplary system of driver-type club heads having face plates made of a titanium alloy (Ti-9s). In the exemplary process of forming the plurality of face plates with varying thickness profiles 160, the average elastic modulus is approximately 115 gigapascals (GPa), the average maximum thickness is approximately 0.140 inches (0.356 cm), and the average minimum thickness is approximately 0.090 inches (0.229 cm).

Referring to FIG. 8, in the exemplary process of forming the plurality of face plates, the thickness profiles 160 of the plurality of face plates vary discretely. For example, the first elastic modulus of the first stock may be between 110 GPa-120 GPa. The first stock can be used to form the first face plate 1140 having the first maximum thickness 1164 of 0.140 inches (0.356 cm) and the first minimum thickness 1168 of 0.090 inches (0.229 cm), resulting in the first face plate 1140. The first face plate 1140 may be coupled to one of the plurality of bodies to form the first golf club head 1100 having the first characteristic time between approximately 238-244 μs. Further, the second elastic modulus of the second stock may be between 120 GPa-130 GPa. The second stock can be used to form the second face plate 1240 having the second maximum thickness 1264 of 0.137 inches (0.348 cm) and the second minimum thickness 1268 of 0.087 inches (2.21 cm), resulting in the second face plate 1240. The second face plate 1240 may be coupled to one of the plurality of bodies to form the second golf club head 1200 having the second characteristic time between approximately 237-243 μs. Further still, the third elastic modulus of the third stock may be between 100 GPa-110 GPa. The third stock can be used to form the third face plate 1340 having the third maximum thickness 1364 of 0.144 inches (0.366 cm) and the third minimum thickness 1368 of 0.094 inches (2.39 cm), resulting in the third face plate 1340. The third face plate 1340 may be coupled to one of the plurality of bodies to form the third golf club 1300 having the third characteristic time between approximately 237-243 μs.

Referring to FIG. 8, the exemplary process of forming the plurality of face plates further includes a fourth stock used to make a fourth face plate 1440. The fourth face plate 1440 may be coupled to one of the plurality of bodies to form a fourth golf club head 1400 having a fourth characteristic time. The fourth stock has a fourth elastic modulus, a fourth maximum thickness 1464, and a fourth minimum thickness 1468. The fourth elastic modulus is greater than the average elastic modulus, the fourth maximum thickness 1464 is less than the average maximum thickness, and the fourth minimum thickness 1468 is less than the average minimum thickness. For example, the fourth elastic modulus of the fourth stock may be between 130 GPa-140 GPa. The fourth stock can be used to manufacture the fourth face plate 1440 having the fourth maximum thickness of 0.133 in and the fourth minimum thickness of 0.083 in, resulting in the fourth face plate 1440. The fourth face plate 1440 may be coupled to one of the plurality of bodies to form the fourth golf club head 1400 having the fourth characteristic time between approximately 238-244 μs.

Referring to FIG. 8, the characteristic time of the exemplary system of driver-type golf club heads manufactured with face plates having the same thickness or thickness profile ranges from approximately 226-250 μs. Further, the average characteristic time of the exemplary system of driver-type club heads manufactured with face plates having the same thickness or thickness profile is approximately 238 μs. Conversely, the characteristic time of the exemplary system of driver-type golf club heads manufactured with face plates having varied thicknesses or thickness profiles according to the elastic modulus of the stock, as described herein, ranges from approximately 237-244 μs. Further, the average characteristic time of the exemplary system of driver-type club heads manufactured with face plates having varied thicknesses or thickness profiles according to the elastic modulus of the stock, as described herein, is approximately 240.5 μs. In the illustrated example, varying the thickness profiles according to the elastic modulus of the stock increased the average characteristic time from 238 μs to 240.5 μs. Further, in the illustrated example, varying the thickness profiles according to the elastic modulus of the stock reduced the range in characteristic time from 24 μs to 7 μs.

In the exemplary process of forming the plurality of face plates according to FIG. 8, the second maximum thickness 1264 and the second minimum thickness 1268 vary from the average maximum thickness and the average minimum thickness, respectively, by 0.003 inches (0.008 cm). In other embodiments, the second maximum thickness 1264 and the second minimum thickness 1268 may vary from the average maximum thickness and the average minimum thickness, respectively, by any increment from 0-0.05 inches (0-0.127 cm). Further, the third maximum thickness 1364 and the third minimum thickness 1368 vary from the average maximum thickness and the average minimum thickness, respectively, by 0.004 inches (0.010 cm). In other embodiments, the third maximum thickness 1364 and the third minimum thickness 1368 may vary from the average maximum thickness and the average minimum thickness, respectively, by any increment from 0-0.05 inches (0-0.127 cm). Further still, the fourth maximum thickness 1464 and the fourth minimum thickness 1468 vary from the average maximum thickness and the average minimum thickness, respectively, by 0.007 inches (0.018 cm). In other embodiments, the fourth maximum thickness 1464 and the fourth minimum thickness 1468 may vary from the average maximum thickness and the average minimum thickness, respectively, by any increment from 0-0.05 inches (0-0.127 cm).

In the exemplary process of forming the plurality of face plates according to FIG. 8, the maximum thickness 164 and the minimum thickness 168 vary by the same increment. In other embodiments, the maximum thickness 164 and the minimum thickness 168 may vary with different increments. For example, the maximum thickness 164 may vary by a greater increment than the minimum thickness 168, or the minimum thickness 168 may vary by a greater increment than the maximum thickness 164. Further, in other embodiments, the maximum thickness 164 may vary while the minimum thickness 168 remains constant, or the minimum thickness 168 may vary while the maximum thickness 164 remains constant.

Further referring to FIG. 8, the average elastic modulus, the average maximum thickness, the average minimum thickness, and the average characteristic time may vary for golf club heads having face plates made of different materials, for similar types of golf club heads having different designs, and/or for different types of golf club heads (e.g., fairway-wood type golf club heads, hybrid-type golf club heads, iron-type golf club heads, wedge-type golf club heads, or putter-type golf club heads). Further, the variations in the maximum thickness 164 and the minimum thickness 168 of the plurality of face plates may differ for golf club heads having face plates made of different materials, for similar types of golf club heads having different designs, and/or for different types of golf club heads (e.g., fairway-wood type golf club heads, hybrid-type golf club heads, iron-type golf club heads, wedge-type golf club heads, or putter-type golf club heads).

Example 2: Thickness Varying Continuously with Elastic Modulus of Face Plate, Resulting in the System of Golf Club Heads with Reduced Variability in Characteristic Time Block 10300 of method 10000 may also be implemented using an exemplary process of forming the plurality of face plates having continuously varying thickness profiles 160 according to the elastic modulus. The exemplary process described herein relates to a system of driver-type club heads having face plates made of a titanium alloy (Ti-9s). In the exemplary process, the variation or change in thickness profile 160 of each face plate within the plurality of face plates may be determined using Relation 3 below.

$$Z = \frac{-0.5714(X) + 306.86 - Y}{1750} \qquad \text{Relation 3}$$

Referring to Relation 3, Z is the change in thickness profile 160 (e.g., change in the maximum thickness 164 and the change in the minimum thickness 168) compared to the average thickness or average thickness profile (e.g., the average maximum thickness and the average minimum thickness). Further, X is the elastic modulus of the stock, and Y is the average characteristic time of the system of golf club heads.

In the exemplary process of forming the plurality of face plates according to Relation 3, the change in thickness profile 160 is applied similarly to the maximum thickness 164 and the minimum thickness 168. In other embodiments, Relation 3 may be determined such that the change in thickness profile 160 may be applied to only to the maximum thickness 164, or only to the minimum thickness 168. Further, Relation 3 may be determined such that the change in thickness profile 160 may be applied differently to the maximum thickness 164 and the minimum thickness 168. For example, the maximum thickness 164 may vary by a greater increment than the minimum thickness 168, or the minimum thickness 168 may vary by a greater increment than the maximum thickness 164. Further, the maximum thickness 164 may vary while the minimum thickness 168 remains constant, or the minimum thickness 168 may vary while the maximum thickness 164 remains constant.

Relation 3 illustrates an exemplary relationship between the elastic modulus, and variation in the thickness of the face plate from the average thickness, for a system of golf clubs having an average characteristic time. Relation 3 may vary, while maintaining the same trend, for systems of golf club heads with different body designs, different club head types (e.g., fairway-wood type golf club heads, hybrid-type golf club heads, iron-type golf club heads, wedge-type golf club heads, or putter-type golf club heads), and different face plate materials.

Using method 10000 to manufacture the system of golf club heads 1000 reduces the range in characteristic time of the system of golf club heads 1000. Further, using method 10000 to manufacture the system of golf club heads 1000 allows the average characteristic time of the system of golf club heads 1000 to be increased, while remaining within the USGA conformance limits.

For example, the method 10000 of manufacturing the system of golf club heads 1000 may reduce the range in characteristic time of the system of golf club heads 1000 to any value less than 20 μs, such as, for example, less than 19 μs, less than 18 μs, less than 17 μs, less than 16 μs, less than 15 μs, less than 14 μs, less than 13 μs, less than 12 μs, less than 11 μs, less than 10 μs, less than 9 μs, less than 8 μs, less than 7 μs, less than 6 μs, less than 5 μs, less than 4 μs, less than 3 μs, less than 2 μs, or less than 1 μs.

For example, the method 10000 of manufacturing the system of golf club heads 1000 may allow for an increase in average characteristic time of the system of golf club heads 1000 to any value greater than 240 μs, such as, for example, greater than 241 μs, greater than 242 μs, greater than 243 μs, greater than 244 μs, greater than 245 μs, greater than 246 μs, greater than 247 μs, greater than 248 μs, greater than 249 μs, greater than 250 μs, greater than 251 μs, greater than 252 μs, greater than 253 μs, greater than 254 μs, greater than 255 μs, greater than 256 μs, or greater than 257 μs.

Reducing the range in characteristic time of the system of golf club heads 1000 results in increased consistency in ball speed and distance for the system of golf club heads 1000. Further, reduced variance in characteristic time allows the average characteristic time of the system of golf club heads to be increased, while maintaining the characteristic time of each golf club head within the system of golf club heads 1000 within the USGA conformance limit. Increased average characteristic time of the system of golf club heads 1000 results in increased ball speed and distance, on average, of the golf club heads within the system of golf club heads 1000.

D. Method of Manufacturing a System of Golf Clubs Having Reduced Variability in Characteristic Time The system of golf club heads 1000 described herein may be part of a system of golf clubs. The system of golf clubs includes the system of golf club heads 1000, a plurality of shafts, and a plurality of grips. Each of the plurality of shafts includes a first end coupled to a golf club head within the system of golf club heads 1000. Each of the plurality of shafts further includes a second end coupled to one of the plurality of grips. The system of golf clubs may include any type of golf clubs, including driver-type golf clubs, fairway wood-type golf clubs, hybrid-type golf clubs, hybrid-type golf clubs, iron-type golf clubs, wedge-type golf clubs, or putter-type golf clubs.

Figure 9:
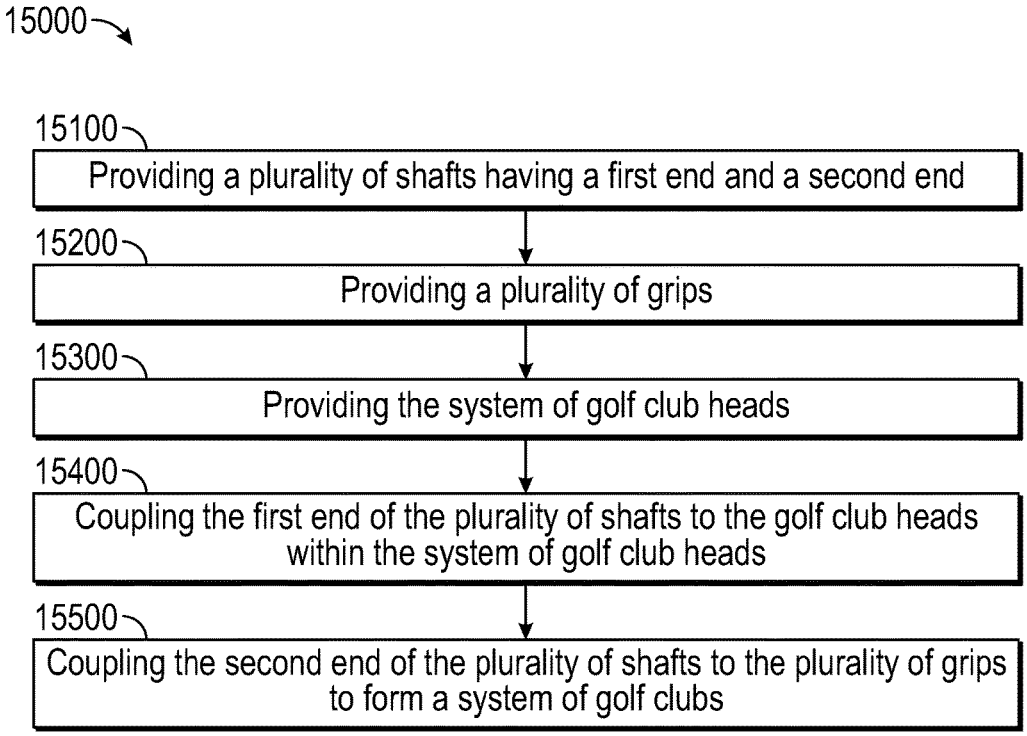
FIG. 9 illustrates a flow chart of an exemplary method of manufacturing a system of golf clubs.

FIG. 9 illustrates a method 15000 of manufacturing the system of golf clubs having the system of golf club heads having minimized range in characteristic time. The method 15000 includes block 15100, block 15200, block 15300, block 15400, and block 15500. Block 15100 of method 15000 includes providing a plurality of shafts having a first end and a second end. Block 15200 of method 15000 includes providing a plurality of grips.

Block 15300 of method 15000 includes providing the system of golf club heads. The system of golf club heads 1000 may be formed using method 10000 described above. Block 15400 of method 15000 includes coupling the first end of the plurality of shafts to the golf club heads within the system of golf club heads 1000. Block 15500 of method 15000 includes coupling the second end of the plurality of shafts to the plurality of grips to form the system of golf clubs.

Clause 1: A system of golf club heads comprising a plurality of golf club heads having a plurality of bodies and a plurality of faceplates, the plurality of faceplates having an average elastic modulus and an average thickness profile defining an average maximum thickness and an average minimum thickness, the plurality of golf club heads including an average characteristic time, a range in characteristic time, a first golf club head having a first characteristic time, a first body, and a first face plate, the first face plate including a first elastic modulus, a first thickness profile defining a first maximum thickness and a first minimum thickness, a second golf club head having a second characteristic time, a second body, and a second face plate, the second face plate including a second elastic modulus, a second thickness profile defining a second maximum thickness and a second minimum thickness, and a third golf club head having a third characteristic time, a third body, and a third face plate, the third face plate including a third elastic modulus, a third thickness profile defining a third maximum thickness and a third minimum thickness, wherein the first elastic modulus is within 5% of the average elastic modulus, the second elastic modulus is greater than the average elastic modulus, and the third elastic modulus is less than the average elastic modulus, the first maximum thickness and the first minimum thickness are approximately equal to the average maximum thickness and the average minimum thickness, respectively, the second maximum thickness and the second minimum thickness are less than the average maximum thickness and the average minimum thickness, respectively, and the third maximum thickness and the third minimum thickness are greater than the average maximum thickness and the average minimum thickness, respectively.

Clause 2: The system of golf clubs of clause 1, wherein the first maximum thickness is positioned in a center region of the first face plate, the first minimum thickness is positioned in a perimeter region of the first face plate, and the first thickness profile decreases in a transition region moving toward the perimeter region.

Clause 3: The system of golf clubs of clause 1, wherein the second maximum thickness is positioned in a center region of the second face plate, the second minimum thickness is positioned in a perimeter region of the second face plate, and the second thickness profile decreases in a transition region moving toward the perimeter region.

Clause 4: The system of golf clubs of clause 1, wherein the third maximum thickness is positioned in a center region of the third face plate, the third minimum thickness is positioned in a perimeter region of the third face plate, and the third thickness profile decreases in a transition region moving toward the perimeter region.

Clause 5: The system of golf club heads of clause 1, wherein the average characteristic time is greater than or approximately equal to 240 μs.

Clause 6: The system of golf club heads of clause 1, wherein the average characteristic time is greater than or approximately equal to 250 μs.

Clause 7: The system of golf club heads of clause 1, wherein the average characteristic time is greater than or approximately equal to 550 μs.

Clause 8: The system of golf club heads of clause 1, wherein the range in characteristic time is less than or equal to approximately 20 μs.

Clause 9: The system of golf club heads of clause 1, wherein the range in characteristic time is less than or equal to approximately 15 μs.

Clause 10: The system of golf club heads of clause 1, wherein the range in characteristic time is less than or equal to approximately 10 μs.

Clause 11: The system of golf club heads of clause 1, wherein the difference between the first maximum thickness and the average maximum thickness, the difference between the second maximum thickness and the average maximum thickness, and the difference between the third maximum thickness and the average maximum thickness, ranges from approximately 0-0.05 inches.

Clause 12: The system of golf club heads of clause 1, wherein the difference between the first minimum thickness and the average minimum thickness, the difference between the second minimum thickness and the average minimum thickness, and the difference between the third minimum thickness and the average minimum thickness, range from approximately 0-0.05 inches.

Clause 13: The system of golf club heads of clause 1, wherein the first, the second, and the third golf club heads are driver-type golf club heads, fairway wood-type golf club heads, hybrid-type golf club heads, iron-type golf club heads, wedge-type golf club heads, or putter-type golf club heads.

Clause 14: A method of manufacturing a system of golf club heads, comprising providing a plurality of club head bodies providing a plurality of stocks having an average elastic modulus, the plurality of stocks further including a first stock having a first elastic modulus within 5% of the average elastic modulus, a second stock having a second elastic modulus greater than the average elastic modulus, a third stock having a third elastic modulus less than the average elastic modulus, forming a plurality of face plates from the plurality of stocks, the plurality of face plates having an average thickness profile defining an average maximum thickness and an average minimum thickness, a first face plate formed from the first stock, the first face plate having a first maximum thickness approximately equal to the average maximum thickness, and a first minimum thickness approximately equal to the average minimum thickness, a second face plate formed from the second stock, the second face plate having a second maximum thickness less than the average maximum thickness, and a second minimum thickness less than the average minimum thickness, a third face plate formed from the third stock, the third face plate having a third maximum thickness greater than the average maximum thickness, and a third minimum thickness greater than the average minimum thickness, coupling the plurality of face plates to the plurality of club head bodies to form a plurality of golf club heads.

Clause 15: The method of manufacturing the system of golf club heads of clause 14, wherein the plurality of golf club heads has an average characteristic time greater than 240 μs.

Clause 16: The method of manufacturing the system of golf club heads of clause 14, wherein the plurality of golf club heads has a range in characteristic time of less than 20 μs.

Clause 17: A method of manufacturing a system of golf clubs, comprising providing a plurality of shafts having a first end and a second end, providing a plurality of grips, providing a plurality of club head bodies, providing a plurality of stocks having an average elastic modulus, the plurality of stocks further including a first stock having a first elastic modulus the same as the average elastic modulus, a second stock having a second elastic modulus greater than the average elastic modulus, a third stock having a third elastic modulus less than the average elastic modulus, forming a plurality of face plates from the plurality of stocks, the plurality of face plates having, an average thickness profile defining an average maximum thickness and an average minimum thickness, a first face plate formed from the first stock, the first face plate having a first maximum thickness approximately equal to the average maximum thickness, and a first minimum thickness approximately equal to the average minimum thickness, a second face plate formed from the second stock, the second face plate having a second maximum thickness less than the average maximum thickness, and a second minimum thickness less than the average minimum thickness, a third face plate formed from the third stock, the third face plate having a third maximum thickness greater than the average maximum thickness, and a third minimum thickness greater than the average minimum thickness, coupling the plurality of face plates to the plurality of club head bodies to form a system of golf club heads, coupling the system of golf club heads to the first end of the plurality of shafts, and coupling the plurality of grips to the second end of the plurality of shafts to form a system of golf clubs.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

What is claimed is:

1. A system of hollow golf club heads comprising: a plurality of golf club heads having a particular loft angle, the plurality of golf club heads including a plurality of bodies and a plurality of face plates, the plurality of face plates having an average elastic modulus and an average thickness profile defining an average maximum thickness and an average minimum thickness, wherein each of the plurality of bodies is substantially the same, the plurality of hollow golf club heads including: an average characteristic time; a range in characteristic time less than or equal to approximately 20 μs; a first hollow golf club head having a first characteristic time, a first body, and a first face plate, the first face plate including: a first elastic modulus; a first thickness profile defining a first maximum thickness and a first minimum thickness; a second hollow golf club head having a second characteristic time, a second body, and a second face plate, the second face plate including; a second elastic modulus; a second thickness profile defining a second maximum thickness and a second minimum thickness; and a third hollow golf club head having a third characteristic time, a third body, and a third face plate, the third face plate including: a third elastic modulus; a third thickness profile defining a third maximum thickness and a third minimum thickness; wherein, the first elastic modulus is within 5% of the average elastic modulus, the second elastic modulus is greater than the average elastic modulus, and the third elastic modulus is less than the average elastic modulus; the first maximum thickness and the first minimum thickness are approximately equal to the average maximum thickness and the average minimum thickness, respectively; the second maximum thickness and the second minimum thickness are less than the average maximum thickness and the average minimum thickness, respectively; and the third maximum thickness and the third minimum thickness are greater than the average maximum thickness and the average minimum thickness, respectively.

2. The system of hollow golf clubs of claim 1, wherein the first maximum thickness is positioned in a center region of the first face plate, the first minimum thickness is positioned in a perimeter region of the first face plate, and the first thickness profile decreases in a transition region moving toward the perimeter region.

3. The system of hollow golf clubs of claim 1, wherein the second maximum thickness is positioned in a center region of the second face plate, the second minimum thickness is positioned in a perimeter region of the second face plate, and the second thickness profile decreases in a transition region moving toward the perimeter region.

4. The system of hollow golf clubs of claim 1, wherein the third maximum thickness is positioned in a center region of the third face plate, the third minimum thickness is positioned in a perimeter region of the third face plate, and the third thickness profile decreases in a transition region moving toward the perimeter region.

5. The system of hollow golf club heads of claim 1, wherein the average characteristic time is greater than or approximately equal to 240 μs.

6. The system of hollow golf club heads of claim 1, wherein the average characteristic time is greater than or approximately equal to 250 μs.

7. The system of hollow golf club heads of claim 1, wherein the average characteristic time is greater than or approximately equal to 255 μs.

8. The system of hollow golf club heads of claim 1, wherein the range in characteristic time is less than or equal to approximately 15 μs.

9. The system of hollow golf club heads of claim 1, wherein the range in characteristic time is less than or equal to approximately 10 μs.

10. The system of hollow golf club heads of claim 1, wherein the difference between the first maximum thickness and the average maximum thickness, the difference between the second maximum thickness and the average maximum thickness, and the difference between the third maximum thickness and the average maximum thickness, ranges from approximately 0-0.05 inches.

11. The system of hollow golf club heads of claim 1, wherein the difference between the first minimum thickness and the average minimum thickness, the difference between the second minimum thickness and the average minimum thickness, and the difference between the third minimum thickness and the average minimum thickness, range from approximately 0-0.05 inches.

12. The system of hollow golf club heads of claim 1, wherein the first, the second, and the third hollow golf club heads are driver-type golf club heads, fairway wood-type golf club heads, and hybrid-type golf club heads.

13. The system of hollow golf club heads of claim 1, wherein the plurality of face plates each has an interior surface opposite a strike surface, and the interior surfaces have the same shape profile.

* * * * *